US005154200A

United States Patent [19]

Hall, Sr.

[11] Patent Number: 5,154,200

[45] Date of Patent: Oct. 13, 1992

[54] GLASSWARE WASHING APPARATUS

[75] Inventor: Jon D. Hall, Sr., Saginaw, Mich.

[73] Assignee: Glastender, Inc., Saginaw, Mich.

[21] Appl. No.: 703,880

[22] Filed: May 22, 1991

[51] Int. Cl.[5] ..... A47L 15/30; A47L 15/42

[52] U.S. Cl. ..... 134/133; 134/153; 134/200

[58] Field of Search ..... 134/133, 134, 148, 153, 134/157, 163, 165, 187, 188, 198, 200

[56] References Cited

U.S. PATENT DOCUMENTS

| | | | |
|---|---|---|---|
| 726,016 | 4/1903 | Blanchard | 134/157 X |
| 1,490,310 | 4/1924 | Blakeslee | 134/200 X |
| 2,608,981 | 9/1952 | Jackson | 134/165 X |
| 3,143,296 | 8/1964 | Wall | 134/165 X |
| 3,192,936 | 7/1965 | Devine | 134/200 X |
| 3,878,856 | 4/1975 | Hall | 134/60 |
| 4,134,413 | 1/1979 | Noren | 134/200 X |
| 4,744,379 | 5/1988 | Goettel | 134/133 X |

FOREIGN PATENT DOCUMENTS

| | | | |
|---|---|---|---|
| 766554 | 9/1967 | Canada | 134/165 |

*Primary Examiner*—Philip R. Coe

*Attorney, Agent, or Firm*—Learman & McCulloch

[57] ABSTRACT

Glassware washing apparatus comprises a cabinet having a stationary spray box for generating a fan-shaped, upwardly directed cleansing spray and a rotatable drive wheel above the spray box for supporting and carrying a rack containing soiled glasses through the cleansing spray. A pass-through assembly is removably supported on the cabinet and includes a rack entry ramp, a rack exit ramp, and an opening between the ramps for receiving the rotatable drive wheel of the cabinet. A hood is removably supported on the pass-through assembly so as to overlie the drive wheel and confine the spray.

12 Claims, 2 Drawing Sheets

GLASSWARE WASHING APPARATUS

FIELD OF THE INVENTION

The present invention relates to a glassware washing apparatus and more particularly to a washing machine having a cabinet within which are a stationary water spray box and a rotatable glassware support rack. Trays containing soiled glassware are movable into and out of the cabinet.

BACKGROUND OF THE INVENTION

Glass washing machines are commonly used in cocktail lounges and bars for rapid and efficient cleansing of soiled beverage glasses. In the use of such machines it is necessary to spray the soiled glasses thoroughly with cleansing and sanitizing materials. Typically, the glasses are held in a wire rack or tray located in a spray cabinet and a rotating cleansing spray is directed against the glasses through the bottom of the rack to clean them.

A glassware washer is known having a cabinet with a stationary rack located above rotating spray arms that direct cleansing sprays upwardly through the rack to impinge on the soiled glasses. The cabinet includes a hood having oppositely disposed entry/exit side doors through which individual racks of glasses can be successively shuttled into the hood for cleaning and then removed through the exit door for drying. However, the use of rotating spray arms leads to loss of water through leakage where the arms are mounted on a support spindle and requires a relatively large water pump to generate a cleansing spray effective to clean the glasses. Use of the large water pump increases the power consumption and the cost of the apparatus. The rotating spray arms cause a good deal of the water sprayed therefrom to be hurled outward by centrifugal force. As a consequence, such water accomplishes no cleansing function and solid entry/exit doors must be employed to avoid loss of the cleaning liquid as a result of such centrifugal force.

A glass washer also is known having a cabinet with a rotatable, spoked drive wheel located above an underlying stationary spray box that directs a fan-shaped cleansing spray upwardly through the rack against the glasses thereon as the rack is rotated by the spoked drive wheel. For the sake of energy efficiency as well as conservation of equipment costs, a small water pump is used to provide the water pressure needed in the spray box to generate the fan-shaped spray from a plurality of spray nozzles on an upwardly facing surface thereof. A box-shaped hood or cover is positioned directly on the base cabinet so as to confront the rack and the spray box in a manner to confine and return the spray to a reservoir in the cabinet. The hood includes a lowermost peripheral lip that is supported on a peripheral shoulder formed about the cabinet. A solid access door is provided on a front side of the hood, through which door an individual rack containing soiled glasses is loaded and then unloaded after cleaning.

The glass washer just referred to is compact and designed for rapid, efficient cleansing of glasses especially as required for use in bars. However, there is a need for a washer of this type having a higher glass cleaning capacity while retaining its relatively compact size and low power consumption that are of prime importance to the bar operator.

SUMMARY OF THE INVENTION

Glass washing apparatus according to the invention comprises a cabinet base supporting a stationary spray box for generating a cleansing spray and a rotatable drive wheel above the spray box for supporting and rotating a rack of articles, such as soiled glasses. The glasses are capable of being cleaned by traveling in a circular path through the cleansing spray. The dishwashing apparatus also includes a rack pass-through assembly disposed on the base of the cabinet and having a rack entry ramp, a rack exit ramp, and an opening between the ramps for receiving the rotatable drive wheel.

A hood closed on two opposite sides and the top, and open on the other two opposite sides is positioned on the pass-through assembly so as to confront the opening and confine the spray from the spray box. The confronting ends of the rack entry and exit ramps are juxtaposed and preferably generally coplanar with the rack drive wheel so that each rack can be easily moved onto the drive wheel from the entry ramp and off the drive wheel to the exit ramp.

The entry and exit ramps extend in opposite lateral directions from the drive wheel to define respective rack loading and unloading zones adjacent opposite sides of the drive wheel. The two open opposite sides of the hood constitute respective rack entry and exit openings but are covered by flexible curtains for confining the spray to the interior of the hood.

In one embodiment of the invention the pass-through assembly is adapted to be received on the upwardly facing shoulder of a conventional base for the cabinet (having a stationary spray box and rotatable drive wheel) in lieu of the conventional four closed side hood. To this end, the pass-through through assembly includes a lower lip that is supported on the shoulder of the base and preferably circumscribes the opening in which the drive wheel is accommodated. The pass-through assembly, in turn, includes upwardly facing shoulders on which the two open-sided hood is removably supported in confronting relation to the opening to confine the spray emitted by the spray box. One embodiment of the invention thus involves use of the pass-through assembly and open-sided hood on a conventional cabinet base so as thereby to increase its cleaning capacity while retaining its desirable compactness and low electrical power usage.

DESCRIPTION OF THE DRAWINGS

The foregoing and other advantages of the invention will become apparent from the following description taken in conjunction with the accompanying drawings wherein.

DETAILED DESCRIPTION OF THE INVENTION

The ensuing description of washing apparatus specifically relates to a glass washer designed for use in bars and adapted to occupy a position beneath a bar top or counter. As such, the washer is compact and set up for rapid, efficient cleansing of glasses. It will be appreciated that the apparatus may take other forms without departing from the principles of the invention.

Figure 1:
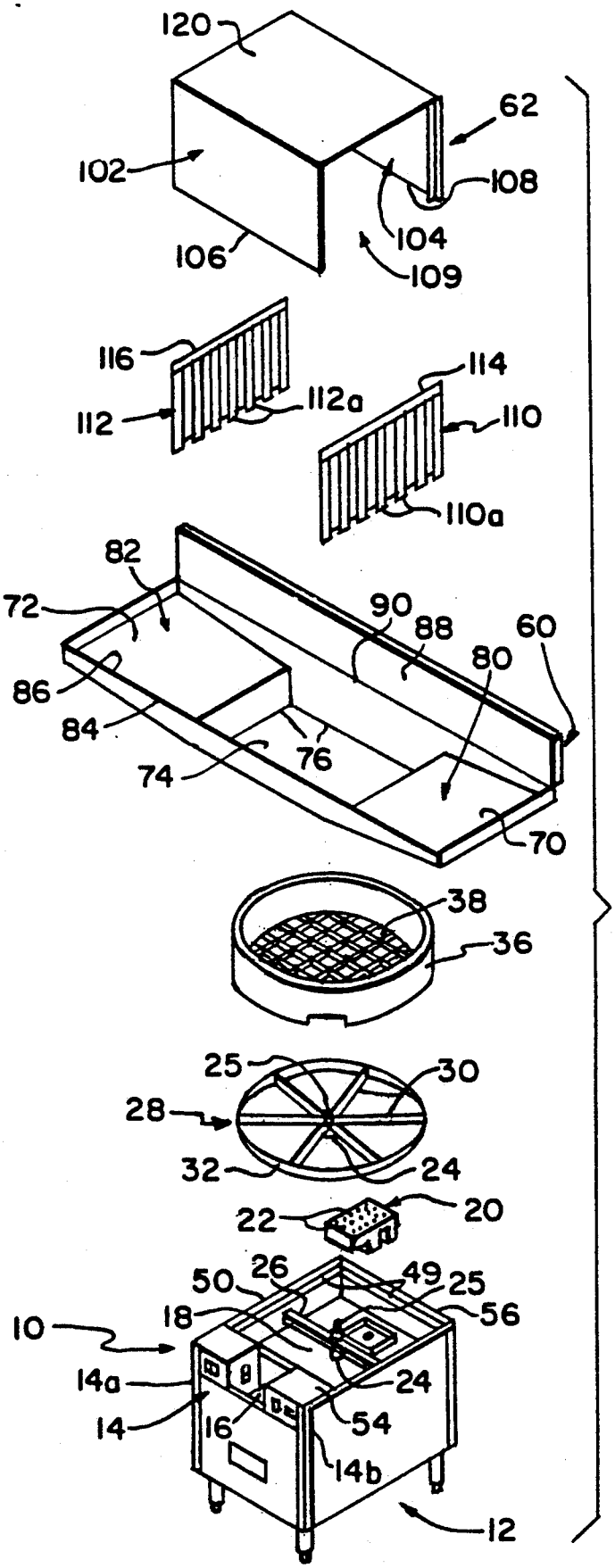
FIG. 1 is an exploded view of a glass washer in accordance with one embodiment of the invention.

Referring to FIG. 1, a glass washer 10 includes a cabinet base 12 having a control panel 14 at the front side. The control panel 14 is divided into left and right portions 14*a*, 14*b* separated by a liquid tank or reservoir 16. The control panel 14 may include a hot water and chemicals dispensing and control system of the type disclosed in commonly owned copending application Ser. No. 586,143 filed Sep. 21, 1990.

To the rear of the reservoir 16 is a washing zone having a drain surface 18 slopes downwardly and forwardly to discharge liquid into the reservoir 16. The drain surface 18 is located well below the top of the cabinet base 12.

A stationary spray box 20 mounted on the drain surface 18 at the rear thereof is coupled to a relatively small (e.g., 1/12 hp) recirculation pump (not shown) which fills the spray box 20 with liquid under pressure to spray the liquid upwardly through a plurality of nozzles 22 in the top surface of the spray box 20. The nozzles 22 may be of the type disclosed in commonly owned copending application Ser. No. 586,253 filed Sep. 21, 1990, for generating an upward fan-shaped spray.

A vertical sleeve 24 located in the cabinet extends upwardly through the drain surface and is fixed to a cross bar 26 which extends from one sidewall 50 of the cabinet to the other 52 as shown. Journalled in the sleeve 24 is a spindle 25 coupled to a driving motor 27. Suitable packing (not shown) encircles the spindle. A rotatable drive wheel 28 comprising circumferentially spaced spokes 30 and a rim 32 has a central hub 34 for removable, driving connection to the spindle 25. A glass rack 36 sized to fit on the drive wheel 28 includes a perforated bottom 38 to support soiled glasses in inverted condition and allow liquid spray from the spray box 20 to impinge on the glasses for cleaning thereof.

The cabinet base 12 and associated components described above correspond to those of a glass washer commercially available from Glastender, Inc., Saginaw, Mich., under the designation GT-18 Glass Washer. The cabinet base has an inner, peripheral shoulder 49 provided on the upstanding walls 50, 52, 54, 56 for the purpose of removably supporting an open bottom, box-shaped hood or cover (not shown) with which the GT-18 Glass Washer conventionally is equipped. Such an open bottom, box-shaped hood is shown in the aforementioned commonly assigned applications.

In accordance with one embodiment of the present invention, the cabinet base 12 and associated components described above are used in conjunction with a pass-through assembly 60 adapted to be supported on the peripheral shoulder 49 of the cabinet 12 and an open-sided hood or cover 62 adapted to be supported on the pass-through assembly 60 so as to increase the glass cleaning capacity of the base cabinet 12 while retaining its compactness and low power usage attributable to the small recirculation pump used to pressurize the spray box 20.

Figure 2:
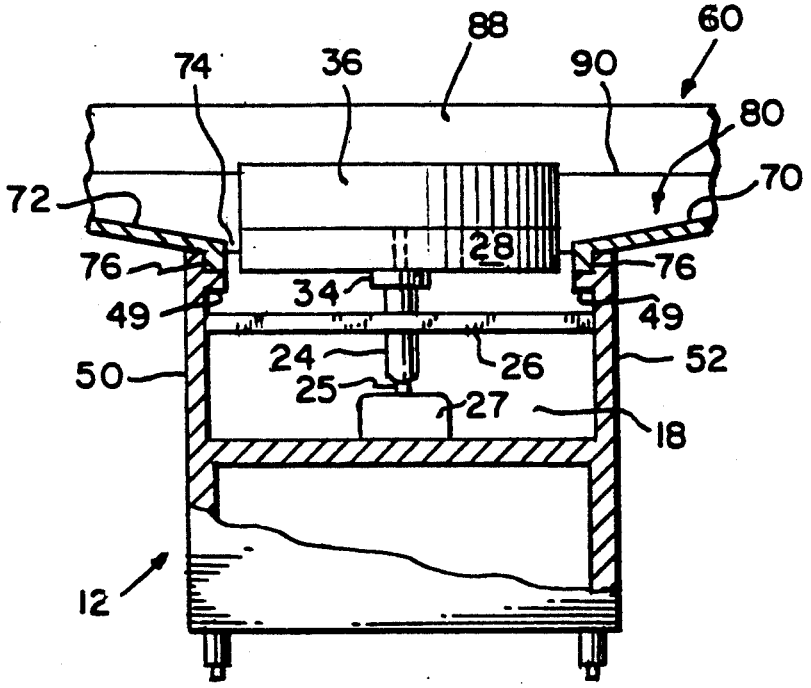
FIG. 2 is a fragmentary sectional view of the pass-through assembly positioned on the cabinet base showing the confronting ends of the rack entry and exit ramps juxtaposed and generally coplanar to the drive wheel.

In particular, the pass-through assembly 60 comprises a rack entry ramp 70, a rack exit ramp 72, and a central opening 74 therebetween adapted to accommodate the drive wheel 28 of the cabinet base 12 as shown best in FIG. 2 when a lower peripheral lip 76 of the pass-through assembly 60 is supported on the shoulder 49 of the base cabinet 12. The lip 76 circumscribes the central opening 74 and is dimensioned/configured to be supported on the shoulder 49 and nested inside the cabinet walls 50, 52, 54, 56.

As shown in FIG. 2, the entry and exit ramps 70, 72 are juxtaposed with their confronting ends generally coplanar with the top of the drive wheel 28 to facilitate sliding of a rack 36 of soiled glasses onto and off of the drive wheel. The entry and exit ramps extend beyond the side walls 50, 52 of the cabinet 12 and are inclined upwardly to define a rack loading zone 80 and a rack unloading zone 82 on opposite sides of the drive wheel 28. The inclination of the ramps enables liquids to drain toward the reservoir.

Referring to FIG. 1, the pass-through assembly 60 includes a raised front rail 84 defining an upwardly facing shoulder 86 and a raised rear guide rail 88 having an upwardly facing shoulder 90. The shoulders 86, 90 extend laterally parallel to one another. As will become apparent, the shoulders 86, 90 are adapted to support the open-sided hood or cover 62 thereon. The raised guide rails 84 and 88 are adapted to guide the racks 36 of soiled glasses as they are moved onto and off the drive wheel 28.

The hood or cover 62 overlies the washing zone and is of such area or size that the wheel 28 lies wholly within the confine of the hood. The hood includes depending front and rear walls 102, 104 that terminate in lower, parallel lips 106, 108 that are dimensioned/configured to be supported on the shoulders 86, 90 of the pass-through assembly 60. The hood or cover 62 has openings at two of its opposite sides (only one opening 109 being shown) that are overlaid by flexible, plastic curtains 110, 112 comprising a plurality of plastic strips 110*a*, 112*a* to confine the cleansing spray from the spray box 20 to the inside the hood. The curtains 110, 112 are hung from straps 114, 116 that are fastened to the top 120 of the hood in any suitable manner. The curtains 110, 112 allow racks 36 easily to be loaded onto and unloaded from the drive wheel 28 when the hood 62 is supported in operative position on the shoulders 86, 90 of the pass-through assembly 60.

The overall height of the assembled apparatus is such that it may be accommodated beneath the horizontal counter of a bar with sufficient clearance, such as about 1 inch, to enable the hood 62 and the pass through assembly to be lifted off the base 12 to provide access to the interior thereof for maintenance and cleaning.

In use, a rack 36 containing soiled glasses is placed on the entry ramp 70 and slid onto the drive wheel 28 through the curtain 110. The operator then starts the washing cycle by suitable manipulation of controls on the control panel 14. While the rack of soiled glasses is being washed, the operator can load one or more additional racks 36 of soiled glasses on the entry ramp 70 in preparation for washing. The entry ramp 70 can be sized to accommodate several racks of soiled glasses in preparation for washing and can thereby free adjacent counterspace for other uses.

After the first rack of soiled glasses is cleaned, it is slid off the drive wheel 28 through the curtain 112 onto the exit ramp 72 where liquid is allowed to drain from the cleaned glasses. Several racks of cleaned glasses can be accommodated on the exit ramp 72 for counterspace saving purposes. The next rack of soiled glasses is then loaded on the drive wheel 28 through the curtain 110. This sequence of rack loading/unloading can be repeated in rapid manner to clean a large number of soiled glasses.

Each rack can be moved individually from the entry ramp onto the drive wheel and from the drive wheel onto the exit ramp. It also is possible to effect discharge of a rack from the drive wheel simply by pushing a rack of soiled glasses from the entry ramp toward the drive wheel.

A particularly advantageous characteristic of the invention is that virtually all of the cleaning water and sanitizing chemicals issuing from the nozzles 22 impinge on the glasses rather than being hurled against the hood walls. However, whatever water is deflected by the glassware is confined by the hood walls and the curtains to the interior of the hood even during passage of a rack to or from the drive wheel.

Another significant advantage of the invention is that the glasses on any rack may be rotated through the spray zone any selected number of times or laps, as determined by the washing cycle, so as to ensure cleansing and sanitizing of the glasses.

While the invention has been described in terms of specific preferred embodiments thereof, it is not intended to be limited thereto but rather only to the extent set forth in the following claims.

I claim:

1. Apparatus of washing articles such as glassware comprising a base having stationary means for generating an upwardly directed cleansing spray; a rotatable, open drive wheel at a level above the spray generating means for supporting and carrying a rack containing such articles through the cleansing spray; a pass-through assembly supported on the base and having a rack entry ramp, a rack exit ramp, and an opening between the ramps for accommodating the rotatable drive wheel and the rack; and a hood overlying said opening for confining the spray, said pass-through assembly being supported on an upwardly facing shoulder of the base.

2. The apparatus of claim 1 wherein the rack entry and exit ramps have confronting ends that are juxtaposed and generally coplanar with the rack drive wheel so that each rack smoothly can be moved onto the drive wheel from the entry ramp and off the drive wheel to the exit ramp.

3. The apparatus of claim 2 wherein the entry and exit ramps extend in opposite directions from the drive wheel to define a respective rack loading zone and rack unloading zone adjacent opposite sides of the drive wheel.

4. The apparatus of claim 3 wherein opposite sides of the hood have respective rack entry and exit openings covered by flexible curtains.

5. The apparatus of claim 1 wherein the pass-through assembly includes a lower lip that is removably supported on the shoulder of the base.

6. The apparatus of claim 5 wherein the lip circumscribes the opening between the entry and exit ramps.

7. The apparatus of claim 1 wherein the pass-through assembly includes upwardly facing shoulders on which the hood is removably supported in overlying relation with the opening between the entry and exit ramps.

8. Apparatus for washing articles such as glassware comprising a base having stationary means for generating an upwardly directed cleansing spray; a rotatable, open drive wheel at a level above the spray generating means for supporting and carrying a rack containing such articles through the cleansing spray; a pass-through assembly supported on the base and having a rack entry ramp, a rack exit ramp, and an opening between the ramps for accommodating the rotatable drive wheel and the rack; and a hood overlying said opening for confining the spray, said pass-through assembly including upwardly facing shoulders on which the hood is removably supported in overlying relation with the opening between the entry and exit ramps.

9. The apparatus of claim 8 wherein the shoulders extend laterally in spaced apart, parallel relation to support spaced apart, parallel front and rear walls of the hood.

10. The apparatus of claim 8 wherein said the means for rotating said drive wheel is operable to rotate the latter through a plurality of circular laps.

11. The apparatus of claim 8 including flexible means forming a displaceable curtain overlying said opening.

12. Apparatus for washing articles such as glassware comprising a base defining a washing zone; stationary means in said zone for generating an upwardly directed, liquid cleansing spray; an open wheel mounted on said base within said zone and at a level wholly above the spray generating means; drive means for rotating said wheel about a substantially vertical axis through said zone and the liquid cleansing spray; and a hood supported by said base and overlying said zone, said hood having an open bottom, a top wall, and at least two side walls supporting said top wall, said hood having at least one open side through which a perforated rack containing one or more articles to be washed may be placed on and removed from said wheel, said hood being of such size that said wheel is wholly within the confines of said hood.

* * * * *

UNITED STATES PATENT AND TRADEMARK OFFICE

CERTIFICATE OF CORRECTION

PATENT NO. : 5,154,200

DATED : October 13, 1992

INVENTOR(S) : Jon D. Hall, Sr.

It is certified that error appears in the above-identified patent and that said Letters Patent is hereby corrected as shown below:

Column 3, line 13, after "18" insert -- which --.

Column 4, line 25, change "confine" to -- confines --.

Column 5, line 27, change "of" to -- for --.

Signed and Sealed this

Twenty-eighth Day of September, 1993

*Attest:*

*Attesting Officer*

BRUCE LEHMAN

*Commissioner of Patents and Trademarks*